United States Patent [19]

Michiels

[11] Patent Number: 4,570,933

[45] Date of Patent: Feb. 18, 1986

[54] RACKET WITH KNOTTING BLOCKS FOR MOUNTING STRINGS

[76] Inventor: Hugo R. Michiels, Hamstraat 2, 9170 Waasmunster, Belgium

[21] Appl. No.: 613,166

[22] Filed: May 23, 1984

[30] Foreign Application Priority Data

Sep. 27, 1983 [BE] Belgium ..... 2/60213
Mar. 20, 1984 [BE] Belgium ..... 2/60367

[51] Int. Cl.[4] ..... A63B 51/12
[52] U.S. Cl. ..... 273/73 D; 273/73 E
[58] Field of Search ..... 273/73 A, 73 D, 73 E; 24/129 R, 128, 114.5, 115 G, 115 H, 131 C

[56] References Cited

U.S. PATENT DOCUMENTS

| | | | |
|---|---|---|---|
| 1,292,317 | 1/1919 | Holding | 273/73 D |
| 1,621,746 | 3/1927 | Morten | 273/73 E X |
| 1,684,449 | 9/1928 | Kleinman | 273/73 E |
| 1,962,701 | 6/1934 | Andrews | 273/73 E |
| 2,446,253 | 8/1948 | Tresidder | 273/73 E X |
| 3,302,950 | 2/1967 | Hartman | 273/73 A |
| 3,884,467 | 5/1975 | Sommer | 273/73 D |
| 4,140,316 | 2/1979 | Coupar | 273/73 A |
| 4,206,917 | 6/1980 | Guillem et al. | 273/73 E |
| 4,330,132 | 5/1982 | Ferrari | 273/73 D |

FOREIGN PATENT DOCUMENTS

| | | | |
|---|---|---|---|
| 125055 | 8/1947 | Australia | 273/73 D |
| 5248 | of 1880 | United Kingdom | 273/73 E |

*Primary Examiner*—Richard C. Pinkham
*Assistant Examiner*—Matthew L. Schneider
*Attorney, Agent, or Firm*—Schwartz, Jeffery, Schwaab, Mack, Blumenthal & Evans

[57] ABSTRACT

A tennis racket frame having a head portion with strings strung thereacross. Holes located in the head portion receive knotting blocks which serve as mounts for the strings. The knotting blocks have two legs and an extending shank arranged in a T-shaped configuration. A central bore is located through the shank of the knotting block for the reception of the strings. One leg of the knotting block is also provided with a bore that is perpendicular or parallel to the central bore. The strings pass through the central bore of the block, through the bore in the leg of the block and then under a portion of the string that extends from the central bore to form a looped string end. The leg of the knotting block that contains the bore also has an undercut portion that allows the string to be wrapped around the leg.

8 Claims, 18 Drawing Figures

Fig. 16
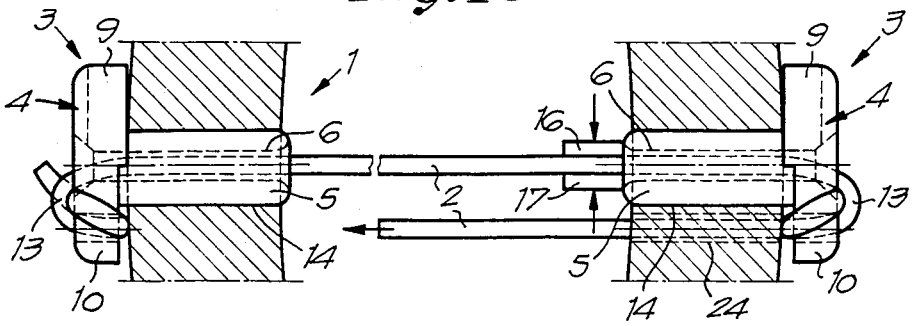
Fig. 17
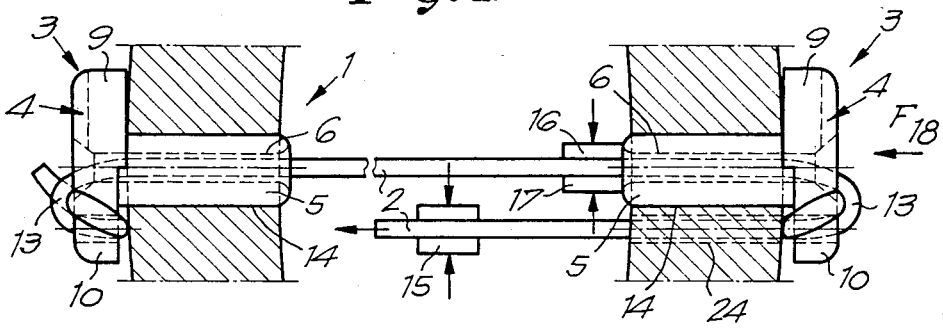
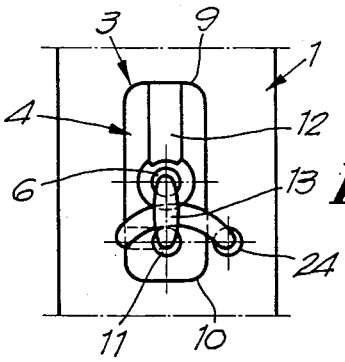
Fig. 18

RACKET WITH KNOTTING BLOCKS FOR MOUNTING STRINGS

BACKGROUND OF THE INVENTION

1. Field of the Invention

The present invention covers a netting for a tennis racket, as well as the procedure enabling installation of such netting and implements used to install such netting.

2. Background Art

It is known that a tennis racket mainly consists of two parts, viz. the frame on one hand and the netting on the other hand.

It is also known that the great disadvantage of present nettings mainly lies in that the string is formed of one single length, installed alternately from left to right and from bottom to top into the frame. Thus, all string portions have one and the same tension and when one string portion is damaged, the entire string must be replaced.

OBJECTS AND SUMMARY OF THE INVENTION

The netting according to the invention has the purpose to exclude the above-mentioned as well as other drawbacks of tennis racket nettings known hitherto and to provide a netting offering, amongst others, the advantages described below.

A first advantage of the netting according to the invention is that not only all kinds of strings can be used but even in one and the same racket, different strings and strings of a different nature, can be applied. For example, gut strings can be used for the central area of the netting and plastic strings for netting the sides of the racket.

Another advantage of the netting according to the invention is that different string tensions can be selected to give the strings in the central area of the racket, especially in the area called the "sweet spot" a certain tension. Whereas the tension in the other strings can for instance be gradually decreased towards the edges of the racket, all in such a manner that the "sweet spot" or high-elasticity area becomes noticeably larger in normal size rackets. In the case of traditional netting, this could previously only be achieved with the usual netting by manufacturing larger rackets.

Another advantage of the netting according to the invention is that upon breakage or damage of a string, replacement can be effected in a minimum of time and at extremely low cost, since it is necessary to only replace the string portion.

Still another advantage of the netting according to the invention is that it enables local modification, adaptation or re-adjustment of the netting, which implies amongst others that if desired, the string tension can be changed or adapted at all times. It thus becomes possible to re-adjust string tension in a very simple manner after some time.

For this purpose the netting of tennis rackets according to the present invention featuring the above as well as other characteristics, mainly consists in that each string or set of string portions is fastened under tension in the racket frame by means of a knot at the ends of such string or set of string portions.

BRIEF DESCRIPTION OF THE DRAWINGS

In order to better appreciate the features of the invention, preferred embodiments are described below by way of example without any restrictive nature, with reference to the accompanying drawings, in which:

FIG. 16 shows a view corresponding to FIG. 8 but for an alternative embodiment;

FIG. 17 is a similar view to FIG. 16 but referring to a later step in the procedure according to the invention;

FIG. 18 shows a view according to arrow F18 in FIG. 17.

DETAILED DESCRIPTION OF THE INVENTION

Figure 1:
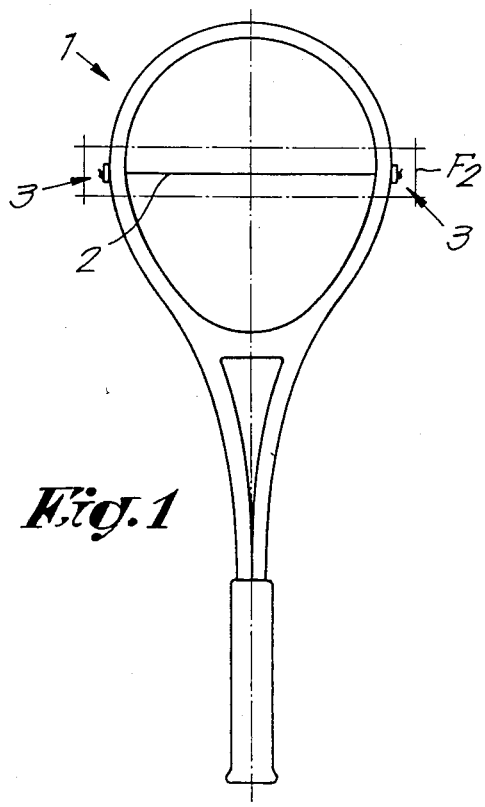
FIG. 1 shows a schematic front view of a tennis racket equipped with a string according to the invention.
Figure 2:
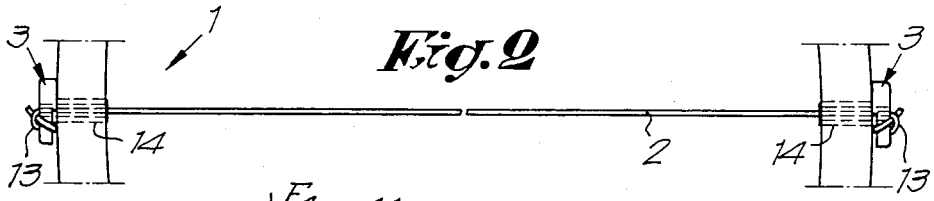
FIG. 2 shows to a larger scale the part indicated by F2 in FIG. 1.
Figure 3:
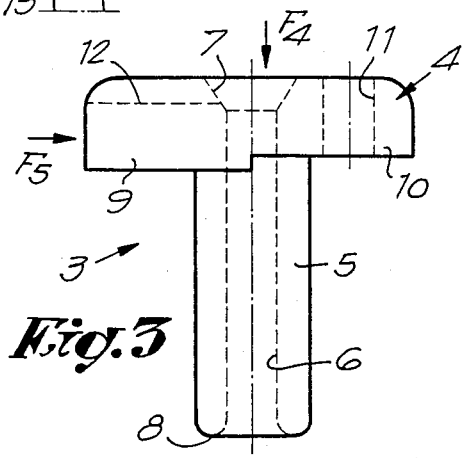
FIG. 3 shows to a much enlarged scale a front view of the implement used for a netting according to the invention.
Figure 4:
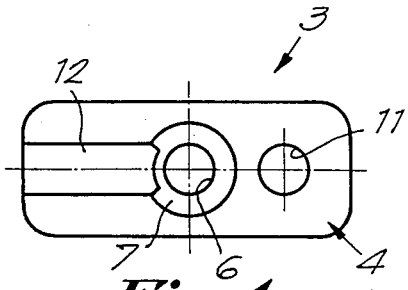
FIGS. 4 and 5 are views according to F4 and F5 in FIG. 3, respectively.
Figure 5:
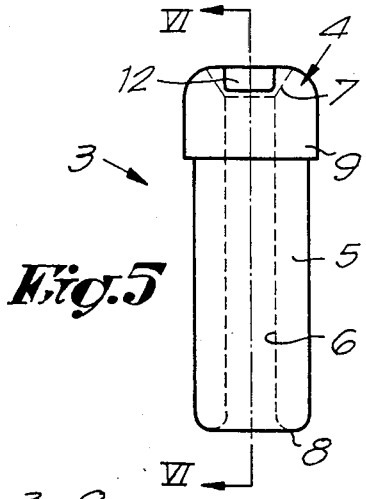
Figure 6:
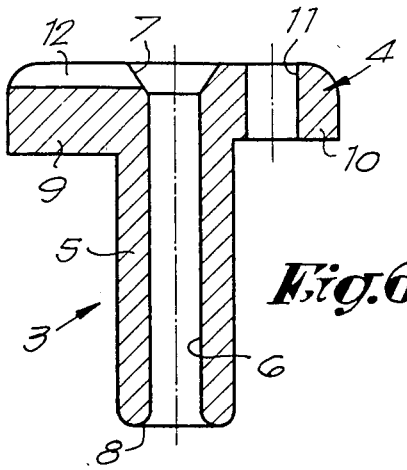
FIG. 6 shows a cross section according to line VI—VI in FIG. 5.

FIG. 1 schematically shows a tennis racket 1 in which a string 2 is fastened in the manner according to the invention.

Both the shape and composition of the racket frame, as well as those of the cross section of this frame are schematic and shown in the drawings in the simplest possible manner.

The netting according to the invention mainly consists of as many strings as there are vertical and horizontal string portions in a given racket. A fastener on the racket frame is provided for each string 2 in the racket frame after tightening of string 2.

In the accompanying figures, this fastener is formed by providing at either end of string 2 a knotting block 3 to which this end is attached after the string has been given proper tension.

The knotting block 3, shown to an enlarged scale in FIGS. 3 through 6, in this embodiment consists of a mainly T-shaped body, whose upper flange 4 is formed by a parallelepiped-shaped body, whereas its vertical flange 5 is formed by a small cylindrical element having an outer diameter fitting exactly into a passage 14 in the racket frame.

Moreover, the knotting block 3 presents a passage 6 for string 2, the upper free end of this passage being provided with a bevelled portion 7 facilitating introduction of a string into passage 6. The lower free end of passage 6 of the flange part 5 is provided with a rounded edge 8, also facilitating introduction of a string.

Flange 4 is composed of two portions, a portion 9 with large thickness and a portion 10 with a small thickness. Portion 10 includes a passage 11 which is parallel to passage 6 and having diameter of which is equal to that of passage 6. Portion 9, has a groove 12 extending from the bevelled edge 7 to the nearest end of flange 4. The groove 12 has a width approximately equal to the diameter of a string 2.

Figure 7:
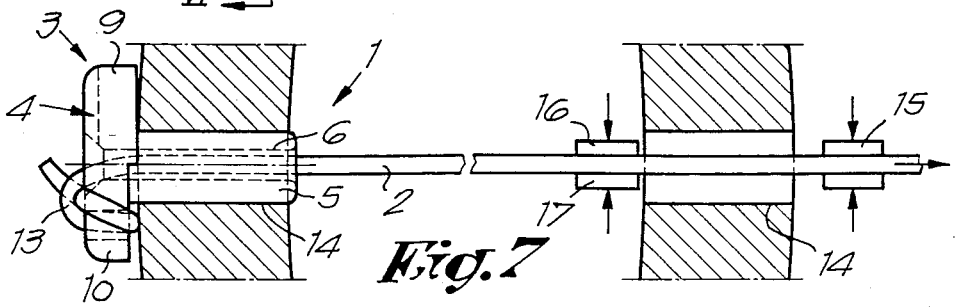
FIGS. 7 8 and 9 show to an enlarged scale three characteristic steps in installation and tightening of a string.
Figure 8:
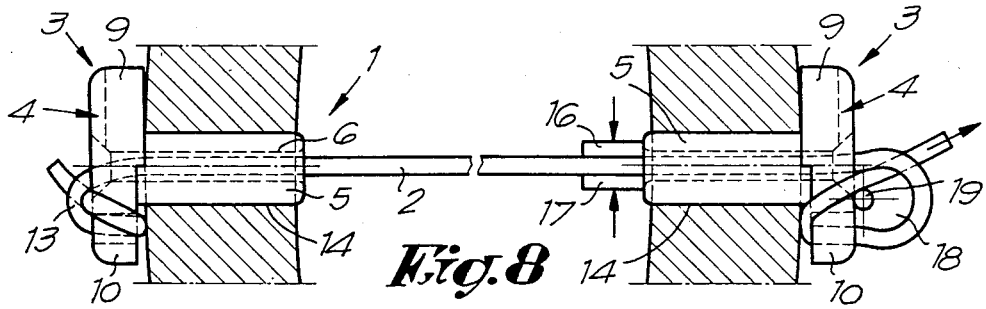
Figure 9:
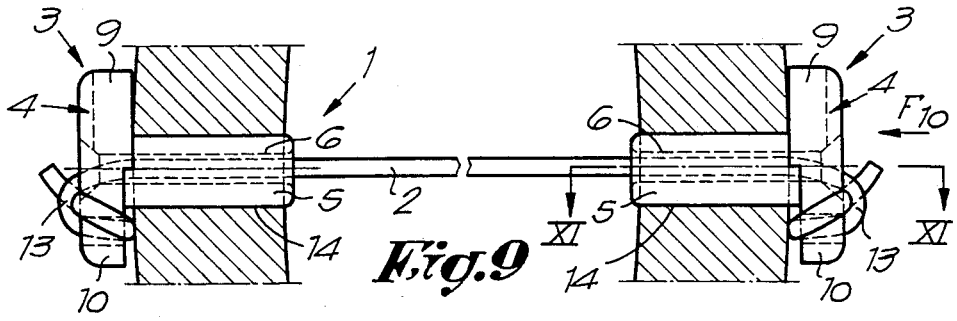
Figure 10:
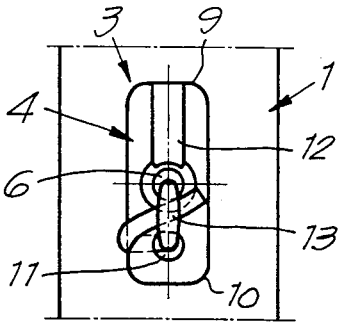
FIG. 10 shows a view according to arrow F10 in FIG. 9.
Figure 11:
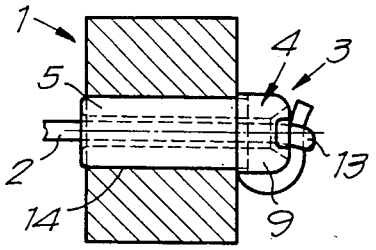
FIG. 11 is a cross section according to line XI—XI in FIG. 9.

FIG. 7 through 9 schematically show how a string 2 can be fastened into the racket frame under a desired tension.

It is possible to introduce the end of string 2 into a knotting block 3, more specifically into its passage 6 and to slip this string end through passage 11 from top to bottom, subsequently folding this free string end upwards again, slipping it through the loop 13 formed by the string portion connecting passage 6 to passage 11.

Next, this string portion, together with knotting block 3, is introduced into a passage 14 in one side of frame 1, whereas the other free end of string 2 is taken through an opposite passage 14 of the racket frame as shown in FIG. 7.

At this moment the free end of string 2 will be retained in a device 15 tightening the string to the desired tension, e.g. in the manner as practiced in traditional netting. After which, the string is caught between clamps 16–17 within the racket frame, e.g. also according to the procedure used in traditional netting. Then, according to the invention, a second knotting block 3 is slipped over the free string end, this end being subsequently moved back through passage 11, so as to finally introduce the string end into loop 18 formed by the string portion connecting passage 6 through passage 11.

Still according to the invention, in order to tighten the string as effeciently as possible before releasing clamps 16 and 17, an implement 19 or the like in the form of a pin or the like, will e.g. be introduced into loop 18. Thus, loop 18 can be pulled up as far as possible before the free string end is stuck through this loop.

Next, the free string end will be thoroughly pulled up, e.g. by means of pliers or the like, to finally release clamps 16 and 17.

It is clear that due to the smaller thickness of portion 10 in block 3, the string 2 can be adequately passed under the block in order not to damage the string by the tension exerted on it.

It is also clear that in this embodiment, when releasing clamps 16 and 17, the tension created in string 2 will slightly recede so that when tightening the string, the desired tension will have to be increased a certain amount in order to maintain the desired tension after completely releasing clamps 16 and 17.

In this manner, a very simple netting offering the aforementioned advantages is obtained.

It is obvious that in the embodiment described by way of example, the knot in the string is made in a very simple and efficient manner by means of knotting block 3, but nothing prevents forming such knot in any other manner.

It would also be possible to provide such a recess at one end in the racket frame 50 that a hollow portion is obtained at the outer edge of the racket frame which is larger than the passage proper for string 2. Such a knot can be made without using a knotting block 3, and this knot can be retained in the hollow, after which a block 3 is provided at the second end of string 2.

Figure 12:
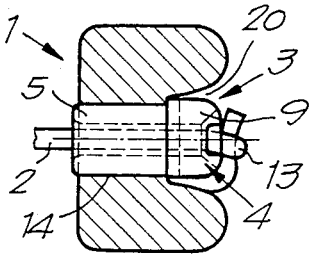
FIGS. 12 and 13 are similar cross sections to those of FIG. 11 but for alternative embodiments.
Figure 13:
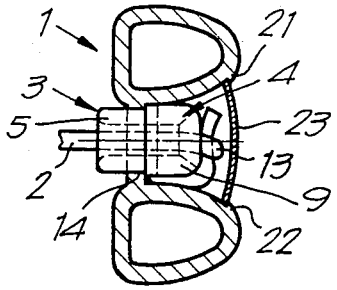

Whereas in FIGS. 1 through 11 the racket frame has a rectangular section, FIG. 12 shows a frame section provided with a circumferential groove 20, all in such a manner that the knotting block 3 with the knot formed around it is contained within the racket circumference to conceal the knotting block 3 from sight. This is exemplified in FIG. 13 showing a metal racket frame provided with ribs 21 and 22, with which can cooperate a cover strip 23.

Figure 14:
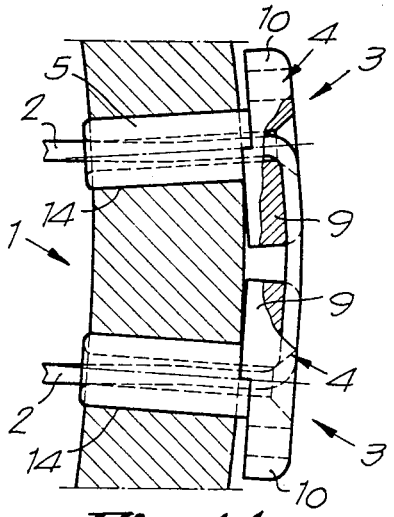
FIG. 14 shows a special application of a netting according to the invention.

FIG. 14 shows that the netting, in addition to being made string per string, can also be effected per two or more strings at a time. It is sufficient to apply the procedure described above, but at the locations where no knot is made, in other words, where the string is simply folded and led back through a next hole 14 in the racket frame, the said knotting blocks 3 will be placed in such a manner as appears from FIG. 14. The grooves 12 are directed towards one another, and the corresponding string portions is laid in these grooves accordingly.

Figure 15:
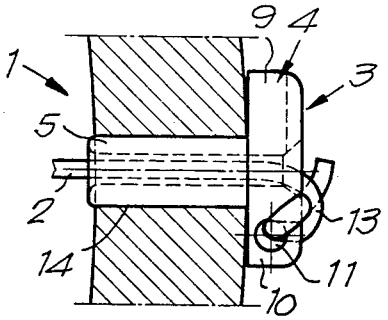
FIG. 15 shows another alternative embodiment of a netting implement according to the invention.

FIG. 15 shows a cross section in which a knotting block 3 is used. The portions 9 and 10 of flange 4 are equally thick, and passage 11 is directed crosswise.

Finally, FIGS. 16 through 18 show an embodiment in which at certain spots and possibly adjacent to each passage 14, a passage 24 is provided through which the free end of string 2 or set of string portions can be led back.

This ensures that after making the last knot in the same manner as described above, the string end is again gripped by a tightening device 15, so that the knot is thoroughly pulled up before releasing the tightening device 15 and clamps 16–17, the initial tension in string 2 or set of string portions being thus completely maintained.

Subsequently, the free end of string 2 will be cut off flush to the inner side of the racket frame.

Although in the first instance it is only necessary to provide a passage 24 at the location of the end of a string 2 or set of string portions, such a passage 24 can be provided both at the beginning of string 2 or set of string portions and at the end of string 2 or set of string portions. This thus also makes it possible to put the beginning of the string through such a passage 24 when making the first knot, in order that the protruding part of the beginning of string 2 can also be cut off flush with the inner edge of the racket frame, which will result in a very clean outer finish of all the knots made.

It is obvious that the present invention is by no means limited to the embodiments described by way of example and shown in the accompanying drawings, but such racket netting and the implements used therefore can be executed in any shape or size without exceeding the scope of the present invention.

I claim:

1. A tennis racket having a frame with a plurality of bores extending from an outside surface to an inside surface, a handle on the frame and netting in the frame, the netting being formed by substantially separate strings, each of which being fastened under tension in the frame on at least one of its ends by means of a pair of knotting blocks mounted on one side of the frame and at least one knotting block on a substantially opposite side of the frame, said knotting blocks comprising:

(a) a substantially T-shaped member having a substantially cylindrical shank and a substantially parallelepiped-shaped head having a pair of legs, said shank being inserted from the outside of the frame into a corresponding bore in the frame;

(b) said shank having a central passage for receiving a string therethrough;

(c) said head having means for receiving an end of said string, said string extending through said central passage in said shank, through said receiving means and under a portion of the string that extends from the central passage to thereby form a looped string end, whereby tension on the string operates to lock the looped string end;

(d) said receiving means comprising a second passage for the string in one leg of the head of said knotting block, said second passage extending parallel to the central passage extending through the shank;

(e) the leg of the head of said knotting block that is opposite to said leg with said second passage being provided at its upper surface with a groove that extends from the central passage to the end of said leg;

(f) said pair of knotting blocks being mounted in adjacent bores on the frame, the grooved legs of the heads of the blocks of said pair being directed towards each other, and a string extending from the central passage of one block and extending from the corresponding groove through the groove of the other block, and then through the central passage of said other knotting block and back into the frame.

2. A tennis racket having a frame with a plurality of bores extending from an outside surface to an inside surface, a handle on the frame and netting in the frame, the netting being formed by substantially separate strings, each of which being fastened under tension in the frame on at least one of its ends by means of a knotting block, said knotting block comprising:

(a) a substantially T-shaped member having a substantially cylindrical shank and a substantially parallelepiped-shaped head having a pair of legs, said shank being inserted from the outside of the frame into a corresponding bore in the frame;

(b) said shank having a central passage for receiving a string therethrough;

(c) said head having means for receiving an end of said string, said string extending through said central passage in said shank, through said receiving means and under a portion of the string that extends from the central passage to thereby form a looped string end, whereby tension on the string operates to lock the looped string end;

(d) said receiving means including, in one leg of the head of said knotting block, a second passage for the string, said second passage extending parallel to the central passage extending through the shank; and (e) the underside of said one leg of the head wherein said second passage is provided being staggered with respect to the underside of the opposite leg over a distance that corresponds to the thickness of the string, thereby providing space for the wrapping of said string about said one leg.

3. A tennis racket according to claim 2, wherein said central passage for the string is widened at its upper and lower ends to facilitate slipping of the string therethrough.

4. A tennis racket according to claim 2, wherein the frame is provided with a bore at the location of the free end of each string, through which the free end of the string can be passed after a knot has been made.

5. A tennis racket according to claim 4, wherein said bore is located under one leg of the head of the knotting block.

6. A tennis racket according to claim 4, wherein said bore runs parallel with the bore into which the knotting block is inserted.

7. A tennis racket according to claim 6, wherein said bore has a diameter that is only slightly larger than the diameter of the string.

8. A tennis racket having a frame with a plurality of bores extending from an outside surface to an inside surface, a handle on the frame and netting in the frame, the netting being formed by substantially separate strings, each of which being fastened under tension in the frame on at least one of its ends by means of a knotting block, said knotting block comprising:

(a) a substantially T-shaped member having a substantially cylindrical shank and a substantially parallelepiped-shaped head having a pair of legs, said shank being inserted from the outside of the frame into a corresponding bore in the frame;

(b) said shank having a central passage for receiving a string therethrough;

(c) said head having means for receiving an end of said string, said string extending through said central passage in said shank, through said receiving means and under a portion of the string that extends from the central passage to thereby form a looped string end, whereby tension on the string operates to lock the looped string end;

(d) said receiving means including, in one leg of the head of said knotting block, a second passage for the string, said second passage extending in a direction normal to the direction of the central passage through the shank.

* * * * *